US011291907B2

(12) United States Patent
Rocks

(10) Patent No.: US 11,291,907 B2
(45) Date of Patent: Apr. 5, 2022

(54) SUPPORT FOR USE WITH A GLOVE

(71) Applicant: Lawrence Rocks, Stony Brook, NY (US)

(72) Inventor: Lawrence Rocks, Stony Brook, NY (US)

( * ) Notice: Subject to any disclaimer, the term of this patent is extended or adjusted under 35 U.S.C. 154(b) by 67 days.

(21) Appl. No.: 16/828,075

(22) Filed: Mar. 24, 2020

(65) Prior Publication Data

US 2021/0299544 A1 Sep. 30, 2021

(51) Int. Cl.
*A63B 71/14* (2006.01)
*A41D 19/015* (2006.01)

(52) U.S. Cl.
CPC ..... *A63B 71/141* (2013.01); *A41D 19/015* (2013.01); *A41D 19/01505* (2013.01); *A41D 19/01523* (2013.01); *A41D 19/01588* (2013.01); *A63B 71/143* (2013.01)

(58) Field of Classification Search
CPC ..... A63B 71/141; A63B 71/143; A41D 19/01505; A41D 19/015; A41D 19/01588; A41D 19/01523
See application file for complete search history.

(56) References Cited

U.S. PATENT DOCUMENTS 1,149,139 A * 8/1915 Heagle ..... A41D 19/00 2/159
3,576,036 A * 4/1971 Latina ..... A63B 71/143 2/19
3,597,765 A * 8/1971 Stanton ..... A41D 19/01564 2/161.3
3,880,426 A * 4/1975 Morse ..... A63D 5/00 473/61
4,843,651 A * 7/1989 Gramza ..... A63B 71/148 2/161.1
5,231,700 A * 8/1993 Cutshall ..... A61B 42/10 2/161.7
5,572,739 A * 11/1996 Kolada ..... A63B 71/143 2/161.1
5,628,069 A * 5/1997 Ebert ..... A41D 19/01547 2/161.1
5,673,437 A 10/1997 Chase
5,745,919 A * 5/1998 Kraatz ..... A41D 19/01505 2/159
6,216,276 B1 4/2001 Eibert
6,219,844 B1 * 4/2001 Yamada ..... A63B 71/143 2/19
6,427,246 B1 * 8/2002 Doi ..... A41D 19/01588 2/161.1

(Continued)

*Primary Examiner* — Khaled Annis
(74) *Attorney, Agent, or Firm* — Lucas & Mercanti, LLP

(57) ABSTRACT

A support for supporting a hand has supporting strips including a first support strip and a second support strip and a mounting device connected to the first supporting strip and the second supporting strip. The mounting device is configured to be worn on a user's hand or connected to the user's hand to hold the first support strip and the second support strip in a mounted position relative to the user's hand. In the mounted position, the first support strip extends along an outer side of a palm and along a palmer side of a little finger of the user's hand and the second support strip extends from a central area of a thumb a central area of an index finger of the user's hand.

17 Claims, 5 Drawing Sheets

(56) References Cited

U.S. PATENT DOCUMENTS 7,179,180 B1 * 2/2007 Frost ..... A63B 60/10 473/458
7,431,671 B1 * 10/2008 Frost ..... A63B 69/0002 473/458
8,852,033 B1 * 10/2014 Frost ..... A63B 60/10 473/458
9,161,579 B1 * 10/2015 Johnson ..... A41D 19/01505
2003/0070209 A1 4/2003 Falone
2005/0229285 A1 10/2005 Chung
2007/0149079 A1 6/2007 Vito
2009/0038052 A1 * 2/2009 Gellis ..... A41D 19/0065 2/161.8
2009/0222967 A1 * 9/2009 Winningham ..... A41D 13/05 2/21
2010/0313332 A1 * 12/2010 Denis ..... A63B 71/141 2/162
2011/0113559 A1 * 5/2011 Dodd ..... B64D 11/0647 5/690
2012/0005805 A1 * 1/2012 Bevier ..... A41D 19/01523 2/161.1
2012/0052968 A1 * 3/2012 Basden ..... A63B 69/3608 473/205
2012/0117703 A1 * 5/2012 Jaramillo ..... A63B 71/143 2/19
2012/0180190 A1 * 7/2012 McNamee ..... A63B 71/143 2/158
2013/0247273 A1 * 9/2013 Hill ..... A41D 19/015 2/164
2014/0059739 A1 * 3/2014 Gellis ..... A41D 19/01547 2/168
2014/0215685 A1 * 8/2014 Bush ..... A63B 71/146 2/161.1
2015/0202521 A1 * 7/2015 Abdelmalek .... A41D 19/01523 2/20
2015/0313298 A1 * 11/2015 Bailey ..... A63B 71/148 2/168
2015/0352428 A1 * 12/2015 Aoki ..... A63B 71/143 2/19
2015/0357948 A1 * 12/2015 Goldstein ..... G06F 3/014 318/16
2015/0359277 A1 * 12/2015 Todorov ..... A41D 19/01505 2/16
2017/0003104 A1 * 1/2017 Andresen ..... A41D 1/06
2017/0157494 A1 * 6/2017 Rivera ..... A41D 19/01523
2017/0248391 A1 * 8/2017 Andresen ..... A43B 7/32
2017/0347727 A1 * 12/2017 Bailey ..... A63B 71/146
2018/0128580 A1 * 5/2018 Pasley ..... F41H 13/0087
2019/0176014 A1 * 6/2019 Chen ..... A63B 71/141
2019/0275403 A1 * 9/2019 Rudan ..... A41D 19/0055
2019/0364997 A1 * 12/2019 Chen ..... B32B 5/024
2020/0077723 A1 * 3/2020 Hyland ..... A63B 71/141
2020/0128891 A1 * 4/2020 Yonliang ..... G01P 15/00
2020/0170824 A1 * 6/2020 Meyer-Clasen ..... A41D 19/01588
2020/0268080 A1 * 8/2020 Schmidt ..... A41D 19/015

* cited by examiner

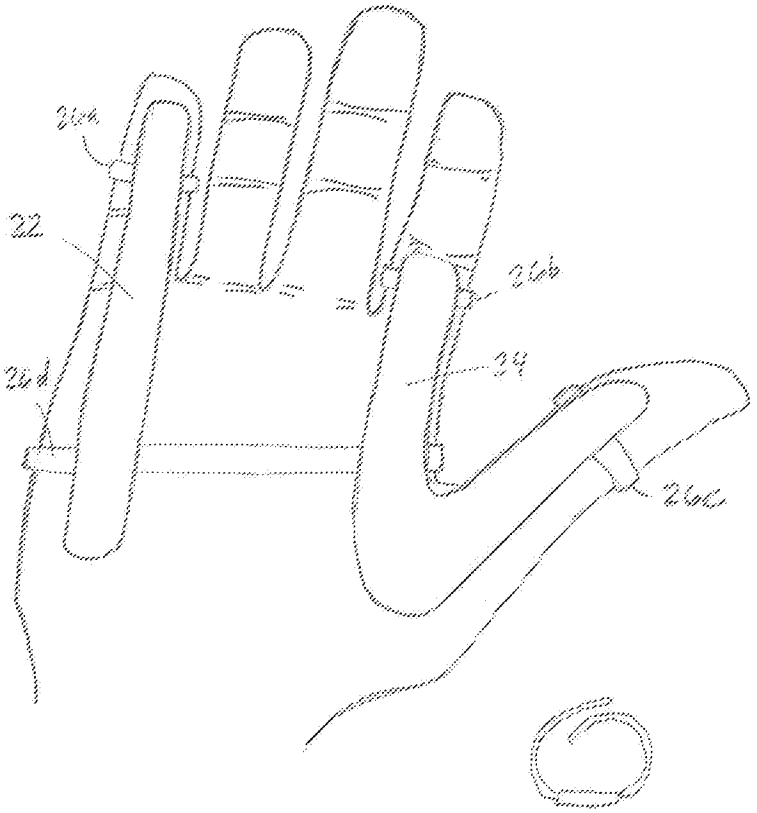
Fig. 7
Fig. 7A
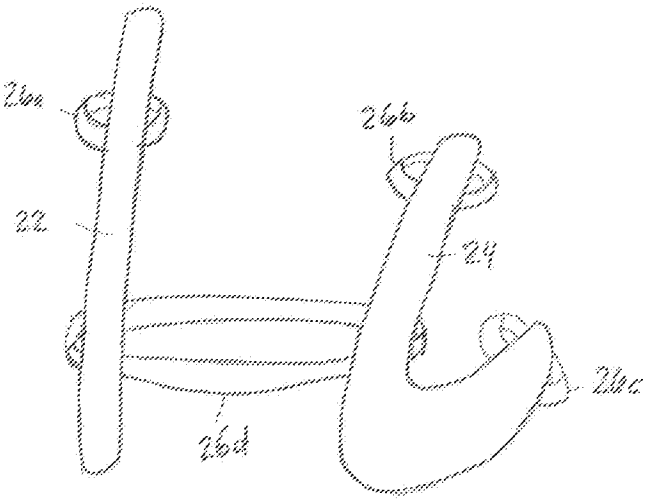
Fig. 6

SUPPORT FOR USE WITH A GLOVE

BACKGROUND OF THE INVENTION

The present invention relates to support strips to deliver more of a user's power to a bat, club, or other held device to which a user's power is transferred.

When a baseball batter swings a bat and contacts a baseball, the batter's hands suffer a compression, which results in a loss of power transfer from the athlete to the bat. A similar problem occurs during a swing of a golf club. Similarly, when a user swings a hammer, a mallet, an axe, a pickaxe or another tool, some of the user's power may not be transferred to the tool.

Many attempts have been made to improve gloves with padding. For example, vibration damping material has been added to gloves to prevent injury to a user's hand. In addition, shields are added to gloves to protect wearers from impacts. However, the vibration damping materials and shields are configured to prevent injury and are not configured to conserve power transfer to a handle of a baseball bat, golf club, or tool.

SUMMARY OF THE INVENTION

An object of the invention is to provide a support or brace that facilitates a transfer of power from a user's hand to a handle of a tool, bat, or club.

The inventor of the present invention has studied the effects of hitting on a batter's hands and has determined that a compression occurs at the upper and lower sides of the hands when a baseball bat contacts the baseball. This compression results in a loss of power that is transferred from the batter's hands to the bat. The present invention is made to avoid the compression at the upper and lower sides of the hands.

The object of the invention is met by a support for supporting a hand that has supporting strips including a first support strip and a second support strip and a mounting device connected to the first supporting strip and the second supporting strip, the mounting device being configured to be worn on a user's hand or connected to the user's hand to hold the first support strip and the second support strip in a mounted position relative to the user's hand. In the mounted position, the first support strip extends along an outer side of a palm and along a palmer side of a little finger of the user's hand and the second support strip extends from a central area of a thumb a central area of an index finger of the user's hand.

In a preferred embodiment, the mounting device is a glove body.

The supporting strips are preferably connected to the mounting device by stitching. However, the supporting strips could alternatively or additionally be connected to the mounting device by an adhesive.

In another embodiment, the mounting device includes at least one elastic band. More specifically, the elastic band includes a first elastic band connected to the first supporting strip for receiving the thumb, a second elastic band connected to the first supporting strip for receiving the index finger, and a third elastic band connected to the second supporting strip for receiving the little finger. The elastic band additionally includes a fourth elastic band connected to the first supporting strip supporting strip and the second supporting strip and is configured to extend around a palmer portion of the user's hand.

The supporting strips are preferably made of an elastomer material. In one embodiment, the elastomer is a polybutadiene alloy.

The object of the present invention is also met by a kit for adding a support to a glove. The kit includes supporting strips including a first support strip and a second support strip, each of the supporting strips including an elastomer layer and an adhesive layer covered by a removable cover, which is removable to expose the adhesive layer so that the each of the supporting strips can be applied to the glove. In this embodiment, the first supporting strip and the second supporting strip are configured to be attached to the glove at a position in which the first support strip extends along an outer side of a palm and along a palmer side of a little finger and the second support strip extends from a central area of a thumb a central area of an index finger of the user's hand.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views:

FIG. 6 is a view of another embodiment of the present invention that is to be worn without a glove;

FIG. 7 is a front view of the embodiment of FIG. 6 mounted on a user's hand;

FIG. 7A is a side view of an alternative embodiment of a holder used in FIG. 6.

DETAILED DESCRIPTION OF THE PREFERRED EMBODIMENTS

Figure 1:
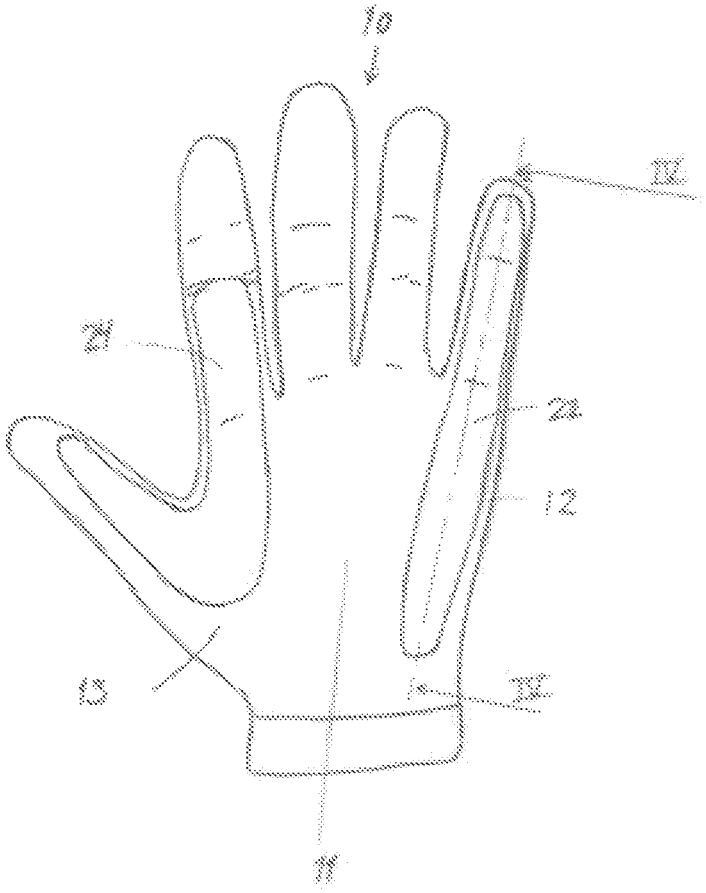
FIG. 1 shows the palm side of a left hand baseball batting glove according to an embodiment of the present invention.

FIGS. 1-4 shows a batting glove for a left hand according to an embodiment of the present invention. Although only the left glove is shown in FIGS. 1-4, the invention is optimally used on both the right and left gloves of the batter. A first support strip 22 and a second support strip 24 (collectively referred to as 'the support strips 22, 24') are arranged on lateral sides on a palmer side of a conventional baseball batting glove 10 (hereafter 'the glove 10'). More specifically, the first support strip 22 extends from a top of the small finger of the glove 10 to a bottom of an outer side 12 of the palm area 11 of the glove 10 (the outer side 12 of the palm is opposite from a thumb side of the palm). The second support strip 24 extends approximately from a first knuckle of the index finger, i.e., one third of the length of the index finger from the palm, to a base area 13 of the thumb on a thumb side of the palm 11, and then extends along the thumb of the glove 10. The support strips 22, 24 are made of a synthetic rubber elastomer. In a specific embodiment, the support strips 22, 24 are made of a Polybutadiene alloy. The support strips 22, 24 are stitched to the glove 10. Alternatively or additionally, the support strips 22, 24 are attached to the glove 10 using an adhesive.

Figure 3:
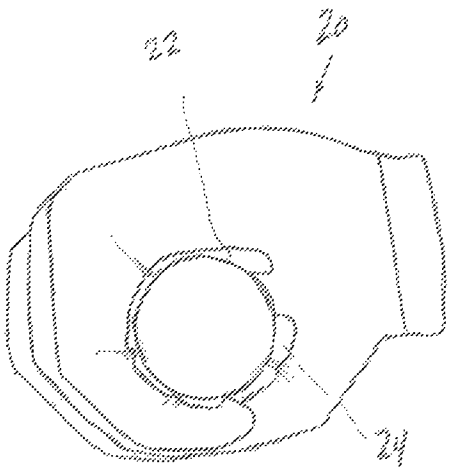
FIG. 3 shows a bottom view of the left hand glove of FIG. 1 holding a bat.
Figure 2:
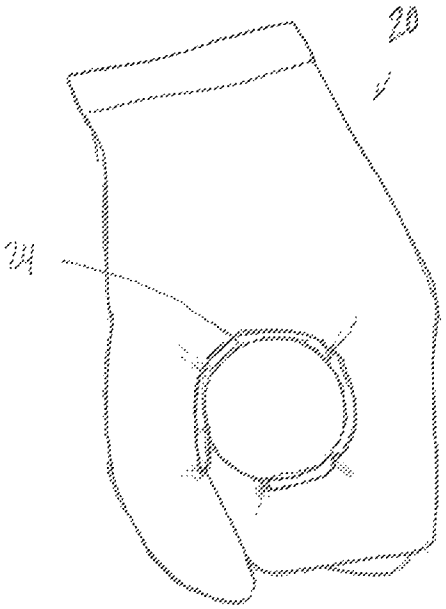
FIG. 2 shows a top view of the left hand glove of FIG. 1 holding a bat.
Figure 4:
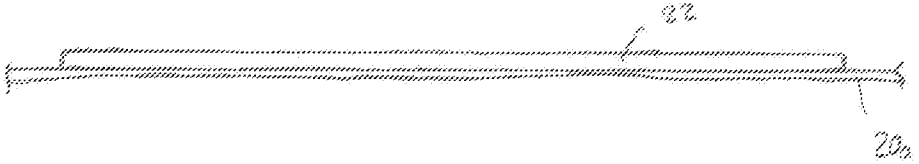
FIG. 4 is a sectional view of the left glove of FIG. 1.

As shown in FIGS. 2-3, the support strips 22, 24 are located on the glove 10 so that the support strips 22, 24 are disposed between the batter's hand and the bat being held when the batter grips the bat while wearing the glove 10. In the embodiment shown in FIGS. 1-4, the support strips are arranged on an outside surface of the glove 10. However, the support strips 22, 24 could also be arranged on an inside surface of the glove 10.

The second support strip 24 is shown as extending to a first knuckle of the index finger, i.e., one third of the length of the index finger, because that is typically the portion that curls around the handle of the bat. However, the second support strip 24 could extend to the end of the index finger. Similarly, the second support strip 24 is shown as extending about half the length along the thumb. However, the second support strip 24 could also extend to the end of the thumb.

Figure 5:
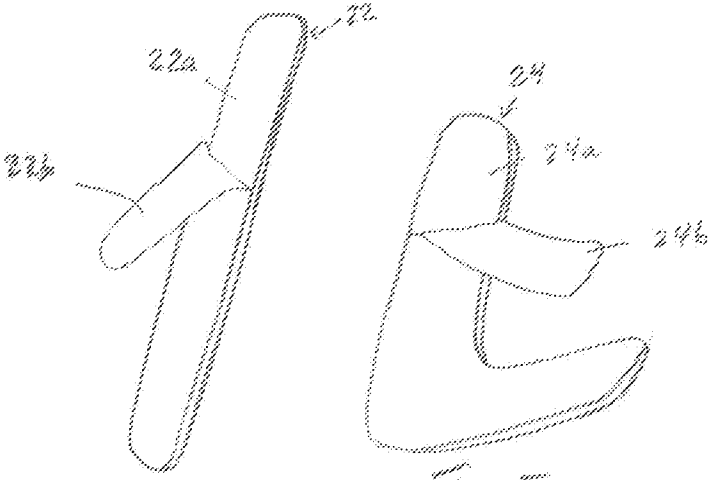
FIG. 5 is perspective view of support strips separate from the glove of FIG. 1.

The support strips 22, 24 may also be made available as a kit to be applied to a glove of the batter's choice. For example, a batter may have a favorite glove and may not wish to try a new glove. However, the batter may be amenable to attaching the support strips 22, 24 to a favorite batting glove. FIG. 5 shows the support strips 22, 24 having a covering 22*b*, 24*b* that covers an adhesive 22*a*, 24*a* until the support strip 22, 24 is ready to be applied to the glove. FIG. 5 shows the supports strips in a state in which the covering 22*b*, 24*b* is being removed and exposing the adhesive 22*a*, 24*a*.

In yet another embodiment shown in FIGS. 6 and 7, the support strips 22, 24 are worn on a user's hand independently of a glove. In the illustrated embodiment, the support strips 22, 24 are connected to bands 26*a*, 26*b*, 26*c*, 26*d* that care used to attach the support strips 22, 24 to a user's hand. As shown in FIGS. 6 and 7, band 26*a* receives the little finger, band 26*b* receives the index finger, band 26*c* receives the thumb, and band 26*d* receives a user's palm. Further bands may be used as required. The bands 26*a*, 26*b*, 26*c*, 26*d* may be formed of an elastic material. Alternatively, the bands 26*a*, 26*b*, 26*c*, 26*d* are made of two pieces that are held together by a hook and loop fastener. In the embodiment of FIGS. 6 and 7, the support strips 22, 24 can be worn under a conventional batting glove.

Figure 8:
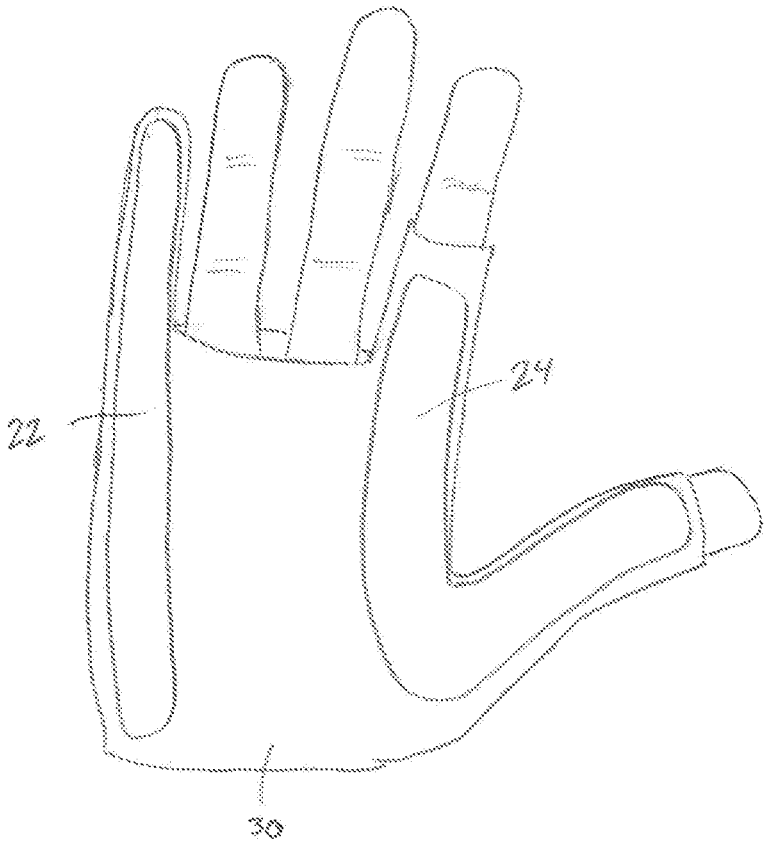
FIG. 8 is a front view of another embodiment of the present invention that is worn on a user's hand.

As a further alternative, the support strips 22, 24 could be mounted on a partial glove 30 that holds the support strips 22, 24 in place relative to the hand. The partial glove 30 includes only the sections necessary to hold the support strips 22, 24 in place. In the embodiment of FIG. 8, the partial glove 30 includes a little finger, an index finger, a thumb, and a palm section. The fingers may be partial as the index finger and thumb are shown in FIG. 8. The partial glove 30 may also be used under a conventional batting glove.

Although the above-described embodiments relate batting glove, the present invention can also be used on a golf glove, a work glove, or any other glove that is used to hold a handle of a tool such as, for example, a hammer, a mallet, an axe, a pickax, or any other tool or sports equipment.

Advantages of the Invention

The support strips 22, 24 arranged according to the present invention at the upper and lower edges of a palm area of the hands act as a brace or support when a user is gripping the baseball bat, the golf club, or the tool handle that reduces the compression of the user's hand that normally occurs at the upper and lower sides of the user's hand during use. Also, the elastomer that is used causes a spring back effect that lessens the compression, thereby allowing more power to be transferred to the baseball, golf ball, or workpiece.

Thus, while there has been shown and described and pointed out the fundamental novel features of the invention is applied to a preferred embodiment thereof, it will be understood that various omissions and substitutions and changes in the form and details of the devices illustrated, and in their operation, may be made by those skilled in the art without departing from the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A device for providing support to a user's hand when a user grips a handle, comprising:

supporting strips including a first support strip and a second support strip;

a mounting device connected to the first supporting strip and the second supporting strip, the mounting device being configured to be worn on a user's hand or connected to the user's hand to hold the first support strip and the second support strip in a mounted position relative to the user's hand, wherein the first support strip is configured to extend in the mounted position from a bottom of the user's hand proximate a wrist of the user along an outer side of a palm of the user's hand and along a palmer side of a little finger of the user's hand, and the second support strip is configured to extend continuously in the mounted position from a central area of a thumb to a central area along a palmer side of an index finger, the supporting strips being configured to be disposed between the user's hand and the handle when the user grips the handle.

2. The device of claim 1, wherein the mounting device is a glove body.

3. The device of claim 2, wherein the glove body is a partial glove.

4. The device of claim 2, wherein the glove body is a baseball batting glove.

5. The device of claim 2, wherein the glove body is a golf glove.

6. The device of claim 1, wherein the supporting strips are connected to the mounting device by stitching.

7. The device of claim 1, wherein the supporting strips are connected to the mounting device by an adhesive.

8. The device of claim 1, wherein the mounting device includes at least one band receiving a portion of the user's hand in the mounted position.

9. The device of claim 8, wherein the at least one band includes a first band connected to the first supporting strip for receiving the thumb in the mounted position, a second band connected to the first supporting strip for receiving the index finger in the mounted position, and a third band connected to the second supporting strip for receiving the little finger in the mounted position.

10. The device of claim 9, wherein the at least one band further includes a fourth band connected to the first supporting strip and the second supporting strip.

11. The device of claim 8, wherein the at least one band is an elastic band.

12. The device of claim 8, wherein the at least one band includes two pieces connected by a hook and loop fastener.

13. The device of claim 1, wherein the supporting strips are made of an elastomer.

14. The device of claim 13, wherein the elastomer is a polybutadiene alloy.

15. The device of claim 1, wherein the supporting strips consist of the first support strip and the second support strip.

16. The device of claim 1, wherein the second support strip extends approximately one third of the length of the index finger.

17. A device for providing support to a user's hand when a user grips a handle, comprising:

supporting strips including a first support strip and a second support strip, the supporting strips being connected or connectable to a glove body configured to be worn on a user's hand to hold the first support strip and the second support strip in a mounted position relative to the user's hand, the first support strip is configured to extend in the mounted position from a bottom of the user's hand proximate a wrist of the user along an outer side of a palm and along a palmer side of a little finger of the user's hand, and the second support strip is configured to extend continuously in the mounted position from a central area of a thumb to a central area along a palmer side of an index finger, the supporting strips being configured to be disposed between the user's hand and the handle when the user grips the handle.

* * * * *